US005450791A

United States Patent [19]

Prohm

[11] Patent Number: 5,450,791

[45] Date of Patent: Sep. 19, 1995

[54] MARKING DEVICE

[76] Inventor: Ronald J. Prohm, 120 Driver La., Cohutta, Ga. 30710

[21] Appl. No.: 177,457

[22] Filed: Jan. 5, 1994

[51] Int. Cl.[6] ..... B41K 1/50; B41K 1/38

[52] U.S. Cl. ..... 101/333; 101/103; 101/DIG. 40; 101/35; 101/41

[58] Field of Search ..... 101/35, 333, 327, 405, 101/406, 41, 4, DIG. 40, 104, 103, 3.1

[56] References Cited

U.S. PATENT DOCUMENTS

| | | | |
|---|---|---|---|
| 1,390,926 | 9/1921 | Reach | 101/DIG. 40 |
| 1,944,259 | 1/1934 | Moore | 101/41 |
| 3,279,359 | 10/1966 | Meyer | 101/333 |
| 4,163,421 | 8/1979 | Sihota | 101/41 |
| 4,875,411 | 10/1989 | Turner | 101/405 |
| 5,014,617 | 5/1991 | Lesyk | 101/333 |
| 5,171,010 | 12/1992 | Lanoue | 273/32.5 |

FOREIGN PATENT DOCUMENTS

| | | | |
|---|---|---|---|
| 0719083 | 10/1965 | Canada | 101/333 |
| 0361270 | 10/1922 | Germany | 101/333 |
| 2012713 | 9/1971 | Germany | 101/333 |
| 0019115 | 7/1914 | Netherlands | 101/333 |
| 0226316 | 10/1923 | United Kingdom | 101/333 |
| 0242197 | 11/1925 | United Kingdom | 101/333 |

*Primary Examiner*—Edgar S. Burr
*Assistant Examiner*—Lynn D. Hendrickson
*Attorney, Agent, or Firm*—Burns, Doane, Swecker & Mathis

[57] ABSTRACT

A marking device for marking designs on golf balls includes a housing in which an ink pad is disposed. At least one marking plug is removably mounted in the housing by a screw thread connection. One end of the marking plug includes a design projection. If more than one marking plug is provided, they have mutually different design projections. The housing has a door for exposing the ink pad. A marking plug can be unscrewed from the housing, and its design projection can be pressed against the exposed ink pad. The design projection can then be pressed against a golf ball to imprint the design upon the golf ball. The marking surface of the design projection can be concavely curved with the same radius of curvature as the outer periphery of the golf ball. The marking device can be dimensioned for being connected to a chain.

12 Claims, 3 Drawing Sheets

Fig. 8
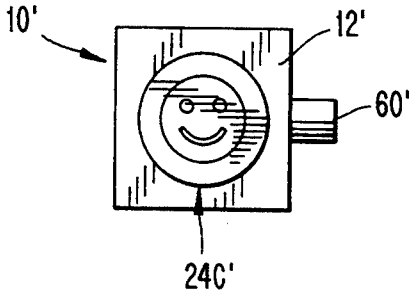
Fig. 9
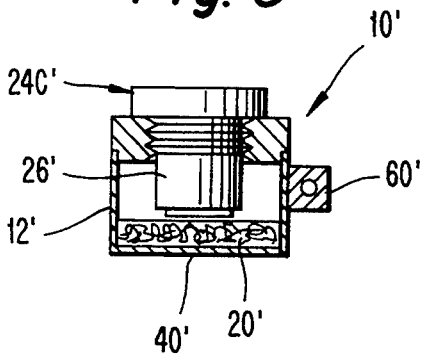
Fig. 11
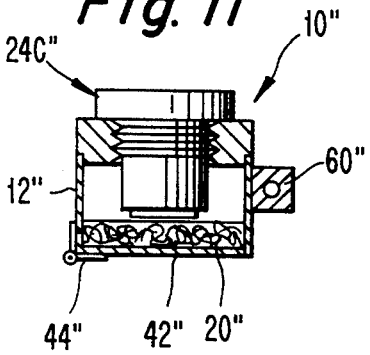
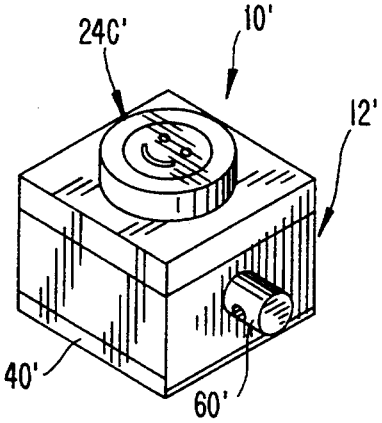
Fig. 10
Fig. 14
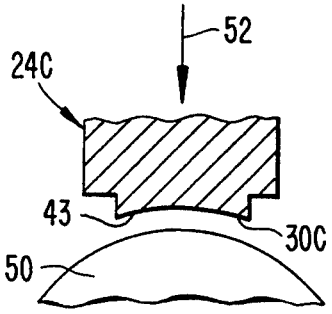
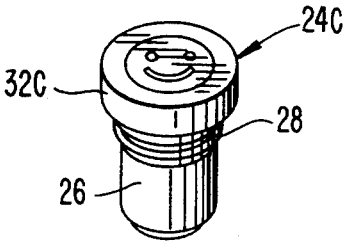
Fig. 12
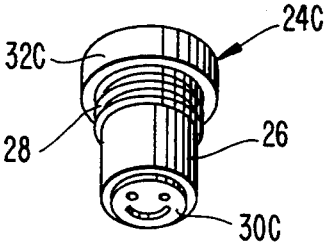
Fig. 13

MARKING DEVICE

BACKGROUND OF THE INVENTION

The present invention relates to a marking device for marking an ink design on objects, especially golf balls.

It is common for a golfer to place a mark on his or her golf ball before playing a round of golf, especially when a number of golfers are playing a round together. By placing marks of different design on the golf balls, it is easier to distinguish the golf balls from one another during play. Marking of the balls is typically performed with a pen, or magic marker, which is somewhat awkward to do.

It would be desirable to provide a device which facilitates the marking of an object such as a golf ball, and which can be conveniently carried by the user.

SUMMARY OF THE INVENTION

The present invention relates to a marking device comprising a housing which defines a chamber in which an ink pad is disposed. At least one marking plug is movably mounted on the housing, the marking plug having a design projection extending from lone end thereof. The housing is arranged to provide access to the ink pad to enable the design projection of a removed marking plug to be pressed against the ink pad.

Preferably, the marking surface of the design projection is of concave shape. More preferably, the radius of curvature of the marking surface corresponds substantially in length to a radius of curvature of an outer periphery of a golf ball.

There are preferably a plurality of marking plugs mounted to the housing. The marking plugs are externally threaded and can be screwed into threaded holes of the housing such that the design projections carried by the marking plugs are situated within the chamber defined by the housing.

Access to the ink pad is preferably provided by a door on the housing which can be slidable, or hinged for example.

The housing may be provided with an eyelet to enable the housing to be connected to a chain for attachment to a golf bag.

BRIEF DESCRIPTION OF THE DRAWINGS

The objects and advantages of the invention will become apparent from the following detailed description of preferred embodiments thereof in connection with the accompanying drawings in which like numerals designate like elements and in which:

FIG. 8 is a top plan view of a marking device according to a third embodiment of the invention;

FIG. 9 is a vertical sectional view taken through the marking device depicted in FIG. 8;

FIG. 10 is a top perspective view of the marking device depicted in FIG. 8;

FIG. 11 is a vertical sectional view taken through a marking device according to a fourth embodiment of the invention;

FIG. 12 is a top perspective view of a marking plug according to the present invention;

FIG. 13 is a bottom perspective view of the marking plug depicted in FIG. 12; and FIG. 14 is a fragmentary sectional view taken through a marking plug according to the present invention as it is being moved toward the outer periphery of a golf ball.

DETAILED DESCRIPTION OF PREFERRED EMBODIMENTS OF THE INVENTION

Figure 1:
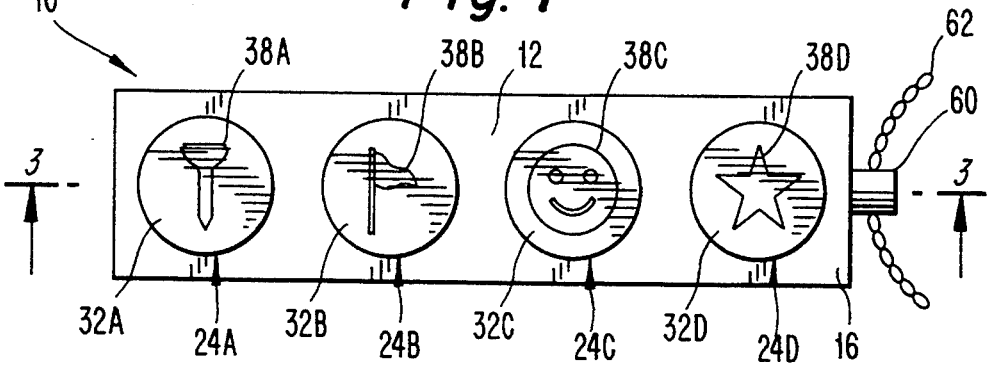
FIG. 1 is a top plan view of a marking device according to the present invention which is connected to a keychain.
Figure 2:
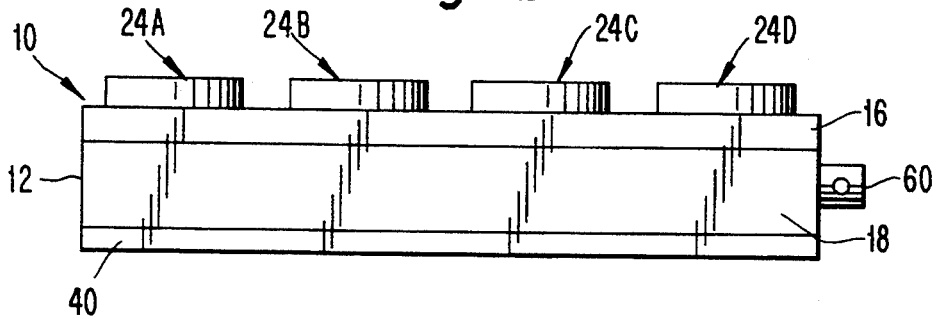
FIG. 2 is a side elevational view of the marking device depicted in FIG. 1.
Figure 3:
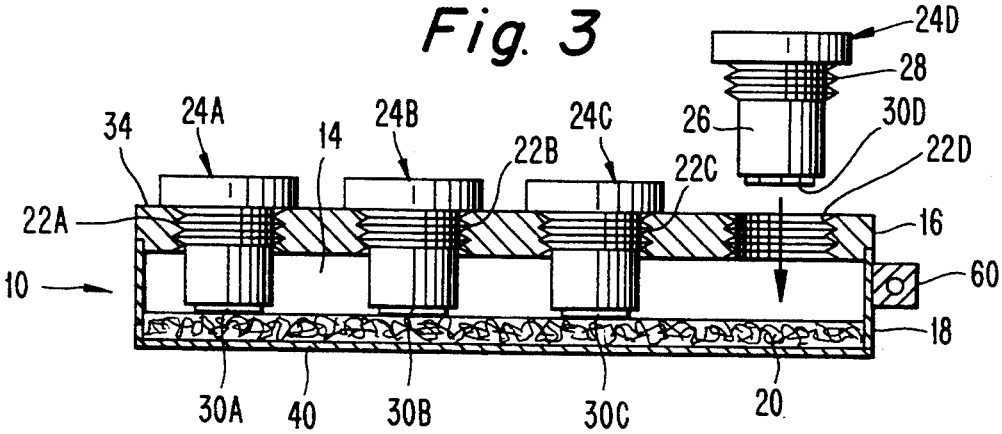
FIG. 3 is a longitudinal sectional view taken along the line 3—3 in FIG. 1, with one of the marking plugs having been removed from the housing.
Figure 6:
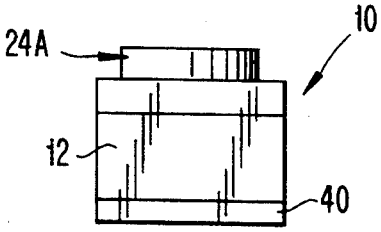
FIG. 6 is an end elevational view of the marking device depicted in FIG. 1.
Figure 7:
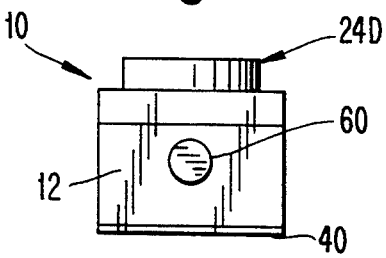
FIG. 7 is an opposite elevational view from FIG. 6.

Depicted in FIGS. 1–7 is a marking device 10 comprising a housing 12 of generally rectangular cross sectional shape defining a chamber 14. The housing includes upper and lower portions 16, 18 which are secured together in any suitable manner, e.g., by adhesive.

Disposed within the chamber 14 is an ink pad 20. The upper portion 16 of the housing 12 includes a plurality of screw-threaded through-holes 22A–22D communicating with the chamber 14. Those through-holes 22A–22D threadedly receive respective marking plugs 24A–24D, each of which includes a cylindrical shaft 26 (see FIGS. 12, 13) on which an external screw thread 28 is formed.

Extending from lower ends of the marking plugs are design projections or design lands 30A–30D, respectively, which are different from one another. Any type of design such as figures, letters, numbers, etc., could be used. When the marking plugs are mounted in the housing, the design projections 30A–30D are disposed within the chamber 14 slightly above the ink pad 20.

Upper ends of the marking plugs 24A–24D comprise enlarged disks 32A–32D which bear against a top surface 24 of the housing to terminate rotation of the marking plugs. The top faces of the disks 32A–32D carry designs 38A–38D which correspond to the respective design projections 30A–30D so that the user can determine which design projection is carried by each marking plug 24A–24D without removing the marking plugs from the housing.

Figure 4:
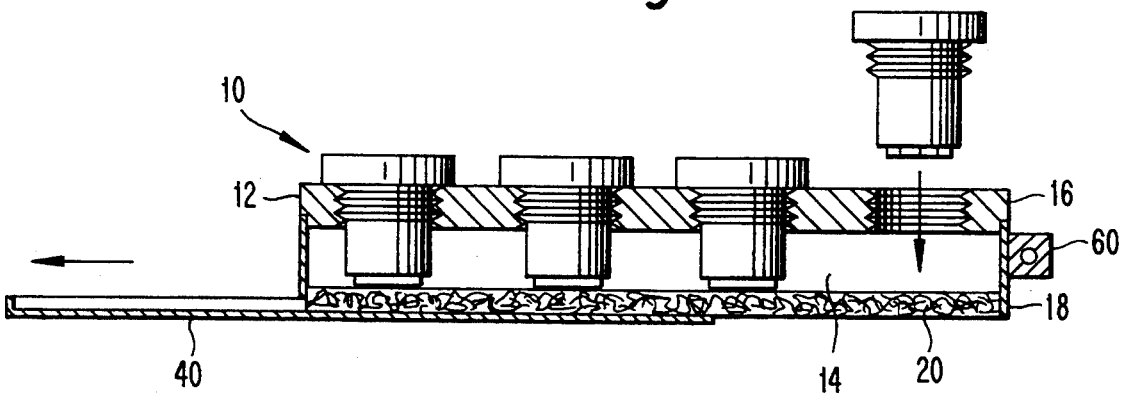
FIG. 4 is a view similar to FIG. 3 showing a slidable door of the housing being in an open state.

The housing 12 includes a door 40 which can be opened to provide access to the ink pad. The door 40 is opened by being slidable as shown in FIG. 4.

Alternatively, a swingable door 42 (FIG. 5) could be provided which is mounted to the housing by a hinge 44. That door 42 would normally be held closed by a friction fit between opposing edges 46, 48. The door 42 could comprise only a portion of the bottom of the housing, as shown, or it could comprise the entire bottom (not shown).

Upon opening the door 40 (or 42) to expose the ink pad, the user can remove one or more of the marking plugs 24A–24D and press the design projection 30A–30D thereof against the ink pad. Then, by pressing the design projection against an article, the respective design can be transferred to the article.

As an alternative arrangement (not shown), the ink pad could be attached to the door 40 or 42 so as to be moved to an exposed position along with the door when the door is opened.

One type of article to which a design can be applied is a golf ball. In that regard, it would be desirable that the marking surface 43 of the design projection be of concave shape as shown in FIG. 14, with the radius of curvature of the marking surface 43 corresponding in length to that of the outer periphery of a standard golf ball 50 so that the design can be easily transferred to that periphery by a linear motion 52 of the marking plug against the ball. Of course, the design projection could have different shapes, such as flat, if desired.

The housing 12 and marking plugs 24A–24D can be formed of any suitable material, such as plastic and metal for example, but metal is preferred. The housing can be made relatively compact, e.g., as small as a few inches in length, if desired, to enable a user to conveniently carry the device. An external eyelet 60 could be provided on the housing for connecting the housing to a keychain 62 (FIG. 1) which could be attached to a golf bag, or used as a keychain.

Figure 5:
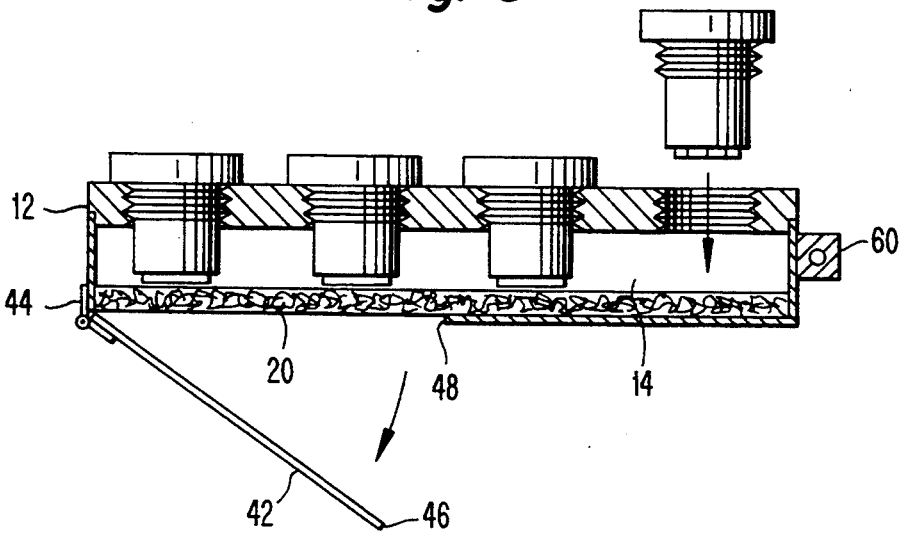
FIG. 5 is a view similar to FIG. 4 which employs a hinged door in the process of being swung open.

In use, a user about to play a round of golf selects one of the marking plugs 24A–24D by viewing the designs 38A–38D provided on the disks 32A–32D. The selected marking plug (e.g., plug 24C) is unscrewed from the housing. The ink pad 20 is then exposed by sliding open the door 40 (FIG. 4), or by swinging open the door 42 (FIG. 5). The design projection 30C of the selected marking plug is then pressed against the exposed ink pad 20 to transfer ink to the design projection 30C. Then, the door 40 (or 42) is closed, and the design projection 30C is pressed against the outer periphery of a golf ball 50 (see FIG. 14) to imprint the design of the design projection 30C upon the ball. In that way, the user will be able to easily identify his or her ball during play.

Although golf balls are typically manufactured with different identifying numbers, it is possible that one or more of the players could coincidentally be using the identical type of golf ball with the same identifying number. No confusion as to whose ball is whose will result, however, if the distinctive design according to the present invention is applied to the ball.

Since the housing 12 carries a plurality of marking plugs (e.g., four), it is possible for the golf balls of a number of players to be marked with distinctive designs.

Instead of exposing the ink pad by opening a door 40 or 42, it would be possible to mount the marking plugs 24A–24D in the housing by a sliding fit, whereby the marking plugs could be pushed toward and against the pad in order to transfer ink to the design projections. In such an arrangement, the through-holes would constitute access means for the ink pad.

Note that if a screw-threaded connection is provided between the marking plugs 24A–24D and the housing (as shown in the figures), it is desirable that the design projections 30A–30D be spaced from the ink pad, so that the ink pad is not ripped by the rotating design projection as the marking plug is being screwed in or out.

Another preferred embodiment 10' of the device is depicted in FIGS. 8–10 wherein only a single marking plug is provided. The parts of the device 10' which correspond to those of FIGS. 1–7 are given the same reference numerals with a prime (') symbol. The device 10' includes a slidable door 40' for providing access to the ink pad 20'. The manner of using this device 10' is the same as the device 10.

A further preferred embodiment 10'' of the invention is depicted in FIG. 11. The elements of that device 10'' which correspond to those of FIGS. 1–7 are provided with the same reference numerals with a double prime (") symbol. The device 10'' includes a hinged door 42'' for providing access to the ink pad 20''.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A marking device, comprising:

a housing defining a chamber and including an upper wall having at least one screw-threaded through-hole opening into said chamber;

an ink pad mounted in said chamber beneath said upper wall and oriented parallel thereto, said ink pad including an upper side facing in a direction toward said upper wall, and a lower side facing in a direction away from said upper wall; and at least one making plug mounted in said at least one through-hole such that a lower end of said at least one marking plug is disposed within said chamber, said lower end including a design projection facing said upper side of said ink pad and spaced thereabove, said at least one marking plug including an upper end having an external screw thread connected to said at least one through-hole, said lower end being of smaller cross-section than said at least one through-hole to enable said at least one marking plug to be inserted and removed therethrough;

said housing including an openable door disposed beneath said ink pad and movable relative to said ink pad to an open state to provide access to said lower side of said ink pad to enable said design projection of a removed marking plug to be pressed thereagainst.

2. A marking device according to claim 1, wherein a marking surface of said design projection is of concave shape.

3. A marking device according to claim 2, wherein said marking surface has a radius of curvature substantially corresponding in length to a radius of curvature of an outer periphery of a golf ball.

4. A marking device according to claim 1, wherein said door is slidably mounted on said housing for sliding movement parallel to a plane of said ink pad.

5. A marking device according to claim 1, wherein said door is swingable about a hinge secured to said housing, said hinge defining an axis oriented parallel to a plane of said ink pad.

6. A marking device according to claim 1, wherein said housing includes an eyelet for being connected to a chain.

7. A marking device according to claim 1, wherein there are a plurality of said marking plugs removably mounted on said housing, said marking plugs having mutually different design projections.

8. A marking device according to claim 7, wherein each marking plug has on its upper end a design corresponding to that of said design projection so that a user can determine which design projection is carried by each marking plug without removing said marking plugs from said housing.

9. A marking device according to claim 8, wherein said housing is of rectangular cross sectional shape, said marking plugs being arranged in a single row.

10. A marking device according to claim 1, wherein a marking surface of said design projection is of concave shape with a radius of curvature thereof corresponding in length to a radius of an outer periphery of a golf ball, said housing including an eyelet for being connected to a chain.

11. A marking device according to claim 4, wherein a marking surface of said design projection is of concave shape with a radius of curvature thereof corresponding in length to a radius of an outer periphery of a golf ball, said housing including an eyelet for being connected to a chain.

12. A marking device according to claim 5, wherein a marking surface of said design projection is of concave shape with a radius of curvature thereof corresponding in length to a radius of an outer periphery of a golf ball, said housing including an eyelet for being connected to a chain.

* * * * *